US005799588A

United States Patent [19]

Engel

[11] Patent Number: 5,799,588

[45] Date of Patent: Sep. 1, 1998

[54] SHELF SYSTEM

[76] Inventor: Zecharya Engel, 173-58 Croydon Rd., Jamaica Estates, N.Y. 11432

[21] Appl. No.: 617,475

[22] Filed: Mar. 15, 1996

[51] Int. Cl.[6] ..... A47B 9/00

[52] U.S. Cl. ..... 108/108; 108/143

[58] Field of Search ..... 108/105, 106, 108/107, 108, 109, 110, 143, 144, 42; 211/193, 187, 102, 94, 90, 94.5, 207, 175; 248/241, 284.1

[56] References Cited

U.S. PATENT DOCUMENTS

| | | | |
|---|---|---|---|
| 534,413 | 2/1895 | Wagner et al. | 108/106 |
| 845,917 | 3/1907 | Worley et al. | 108/108 X |
| 1,204,286 | 11/1916 | Lengquist et al. | 108/96 |
| 1,940,877 | 12/1933 | Ochse . | |
| 3,640,389 | 2/1972 | Snyder . | |
| 4,056,196 | 11/1977 | Brauning . | |
| 4,620,489 | 11/1986 | Albano | 108/108 X |
| 4,651,652 | 3/1987 | Wychoff . | |
| 4,771,898 | 9/1988 | Howard et al. | 108/109 X |
| 4,919,282 | 4/1990 | Duff et al. . | |
| 4,934,645 | 6/1990 | Breslow | 108/108 X |
| 5,014,862 | 5/1991 | Bustos . | |
| 5,071,098 | 12/1991 | Aldridge | 248/284.1 X |
| 5,439,122 | 8/1995 | Ramsay | 211/187 |

FOREIGN PATENT DOCUMENTS

| | | | |
|---|---|---|---|
| 40278 | 6/1932 | France | 108/108 |

*Primary Examiner*—Jose V. Chen
*Attorney, Agent, or Firm*—Friscia & Nussbaum

[57] ABSTRACT

A moveable shelf is provided for a shelf system containing shelves in a stack arrangement mounted to uprights or side walls. The uprights or side walls include one or more shelf support members which support the shelves. One or more of the shelves are movable out from the shelf stack, either by way of a telescoping support member, or otherwise, to permit movement of such shelf or shelves to or past a lower shelf. After an upper shelf or shelves are moved vertically past a lower shelf, the upper shelf or shelves can be moved back into alignment with the lower shelf. In this arrangement, the upper shelf or shelves thereby become positioned below the lower shelf to permits easy access to the upper shelf or shelves.

18 Claims, 6 Drawing Sheets

SHELF SYSTEM

BACKGROUND OF THE INVENTION

1. Field of the Invention

This invention generally relates to a storage system having an upper storage area that can be moved downward Lo be easily accessed, and more specifically to such a storage system having an upper shelf, drawer, hanging rod, etc., that can be moved downward to or past a lower storage area. The lower storage area or shelf may be movable upward past the upper storage area, such that the lower storage area and the upper storage area trade places to permit the storage areas to be easily accessed.

2. Related Art

Shelves and shelf systems are widely used for displaying and storing items. Sometimes shelves are contained within cabinets, armoires, closets, etc., while others such as supermarket shelves or book shelves are free-standing and, by design, easily accessible. Importantly, the word "shelf" or "shelves" as used herein includes within its definition shelves, drawings, hanging rods, etc., for supporting items thereon or therefrom.

Importantly, the height to which a stack of shelves can extend is typically limited by the reach of a person of average size. Alternatively, in some cases upper shelves are positioned out of the reach of people and various tools must be employed in order for a person to access such shelves. Such tools include footstools, stepladders, reach poles, etc. The use of such tools, however, can be dangerous. For example, people are frequently injured from falls off of stepladders and/or footstools. Likewise, the use of reach poles can easily result in knocking the desired item, or even another item, from the shelf such that the item is broken. Worse yet, such a falling item could hit and injure the person using the reach pole or another person in the vicinity thereof. Additionally, such tools are typically a nuisance to have about, can lead to injuries merely by tripping a person, and are frequently misplaced or not readily available for use. Additionally, the shelf system of the present invention also facilitates safe usage of storage areas by children and/or handicapped people including wheelchair bound people.

In the past, there have been some efforts at providing moveable shelves to overcome the problems associated with fixedly positioned shelves. Examples of such of previous efforts at moveable shelves include:

Ochse, U.S. Pat. No. 1,940,877 discloses extension shelving for display cabinets wherein the shelving may be drawn out of the display cabinet by means of tracks and rollers, and the shelves may be tilted to assume a rearward ascending step-wise arrangement, the lowermost shelf extending forward of the cabinet and the upper shelves.

Snyder, U.S. Pat. No. 3,640,389 discloses a display stand and expandable shelf for use thereon comprising a base and a pair of upright shelf supports. The components of the system are slidably engageable with each other and conventional fastening means are not required for assembly. Additionally, the shelves include a portion (80) that can be extended vertically upward from the remainder of the shelf (70) to form a step. Likewise, another portion (90 and 96) can be extended horizontally outward from the shelf to form a wider shelf, again having a step.

Brauning, U.S. Pat. No. 4,056,196 discloses a supporting framework for shelves including crosspieces interconnected with uprights. The cross pieces can ride up and down the uprights and when positioned in a desired location, can be locked into place by locking means.

Wyckoff, U.S. Pat. No. 4,651,652 discloses a vertically adjustable work desk that is raised by a force applied by a lockable gas spring via a first pulley system. A second pulley system insures that all areas of the work surface are equally raised.

Duff et al., U.S. Pat. No. 4,919,282 discloses movable gondola shelving for merchandise display having a rolling base supporting channeled uprights and a center panel. Cantilevered shelves are interconnected with the channeled uprights by means of cam assemblies at the rear corners of the shelves. The cam assemblies allow for the shelves to be vertically adjusted while the shelves are maintained in a level position.

Bustos, U.S. Pat. No. 5,014,862 discloses an assembly for a cantilevered display header for a gondola display rack comprising two uprights braced to the gondola display rack in vertical spaced relation. The header, which is basically a light box that can receive a sign for illumination thereof, is mounted separately from the shelf and is vertically moveable with respect thereto for adjusting the height of the header with respect to the shelf.

None of these previous efforts, however, teach or suggest the benefits and advantages of the present invention, nor do such previous efforts show or describe the structural configuration of the present invention.

OBJECTS AND SUMMARY OF THE INVENTION

It is a primary object of the present invention to provide a moveable shelf system for permitting easy access to shelves.

It is another object of the present invention to provide a shelf system having an upper shelf can be moved downward for easy access.

It is another object of the present invention to provide a shelf system having an upper shelf or shelves which can be moved downward to a position even with a lower shelf.

It is even another object of the present invention to provide a shelf system having an upper shelf that is moveable downward past a lower shelf.

It is still another object of the present invention to provide a shelf system which allows for positioning shelves to higher level than conventional shelves.

It is still even a further object of the present invention to provide a shelf system wherein the shelves can be positioned to a higher level and yet the shelves can still be readily accessed.

It is a further object of the present invention to provide a shelf system wherein the upper shelf can accessed with the need for using a reaching tool.

It is a further object of the present invention to provide a shelf system wherein the upper shelf can accessed with the need for stepping onto an object to raise oneself higher off of the floor.

It is an additional object of the present invention to provide a shelf system wherein the upper shelf and the shelf therebelow can be interchanged with respect to the positioning thereof.

It is still a further object of the present invention to provide a shelf system wherein the upper shelf does not move unless it is pulled out from the shelf system.

It is even a further abject of the present invention to provide a shelf system wherein the upper shelf can be automatically actuated to move.

It another object of the present invention to provide a shelf system wherein a plurality of shelves can be moved past one or more shelves.

It is an important object of the present invention to provide a shelf system that can be retrofitted to existing shelf systems to increase the height to which and/or the amount of shelves that can be stacked together.

It is also an object of the present invention to provide a shelf system that can be incorporated into enclosures having shelves therein, such as cabinets, closets, armoires and the like.

Additionally, it is an important object of the present invention which provides a shelf system that allows for the relatively safe access to the items thereon.

These and other objects are achieved by the shelf system of the present invention which includes two or more shelves in a stack arrangement mounted to uprights or side walls. The uprights or side walls include one or more shelf support members which support the shelves. One or more of the shelves are movable out from the shelf stack, either by way of a telescoping support member, or otherwise, to permit movement of such shelf or shelves to or past a lower shelf. After an upper shelf or shelves are moved vertically to or past a lower shelf, the upper shelf or shelves may be moved back into alignment with the lower shelf. In this arrangement, the upper shelf or shelves can thereby become positioned below the lower shelf. This permits easy access to the upper shelf or shelves.

Vertical movement of the upper shelves and the lower shelf can be facilitated through a pulley arrangement whereby the upper shelf and the lower shelf are interconnected and constrained to move together in opposite directions. Also, rollers may be used to facilitate such movement of the shelves. Accordingly, movement of one roller corresponding to an upper shelf causes a corresponding opposite movement of another roller corresponding to a lower shelf, and thereby, movement of one shelf causes a corresponding opposite movement of the other shelf. Alternatively, tracks can interconnected with side wall members of a shelf system to guide the movement of upper shelves out from the stack, to or past a lower shelf, and back into position with the stack of shelves. Importantly, an upper shelf can be moved down the stack to take the place of a lower shelf so that the upper shelf can be accessed.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

Figure 1:
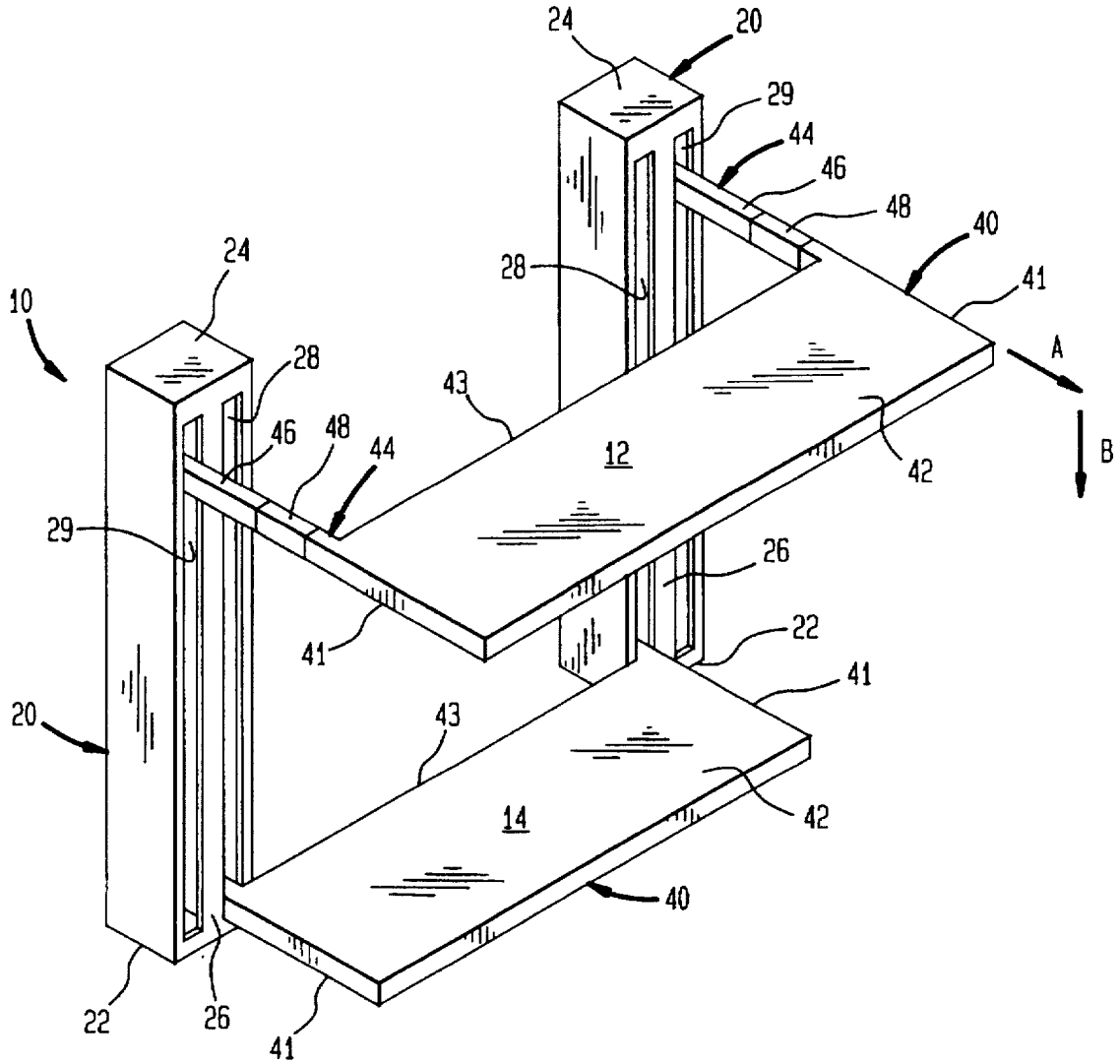
FIG. 1 is a perspective view of a preferred embodiment of the shelf system of the present invention.
Figure 2:
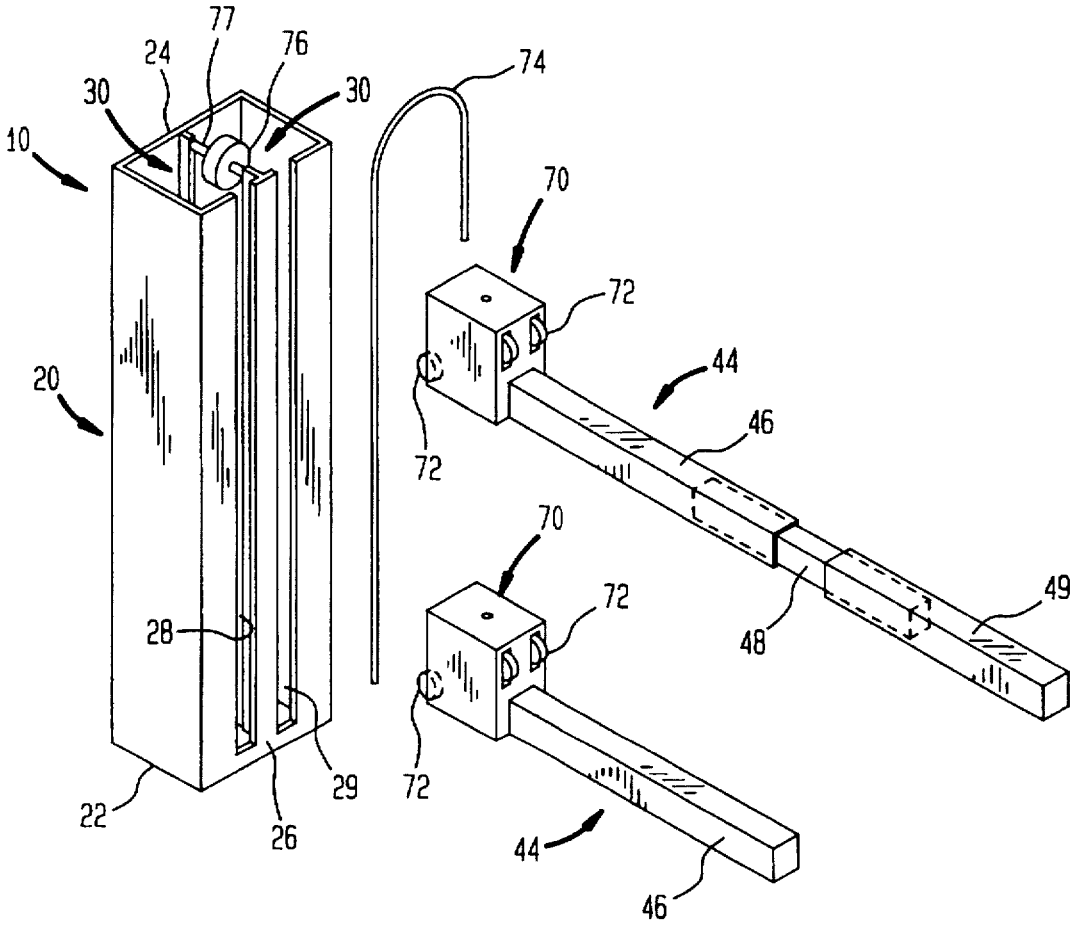
FIG. 2 is a partially exploded partial view an upright member, with a shelf support members, and a pulley member for use in the system shown in FIG. 1.

Referring to FIGS. 1 and 2, the shelf system of the present invention, generally indicated at 10, includes uprights generally indicated at 20, shelves generally indicated at 40, and shelf support members generally indicated at 44. Importantly, the shelf system 10 can be used alone or in connection with conventional shelves, or other storage areas as hereinbefore set forth, of any size or shape. Additionally, the shelf system can manufactured as part of a shelf unit or can be retrofitted to an existing shelf unit.

As shown in the FIGS., the shelf system 10 comprises an upper shelf 12 and a lower shelf 14. As will hereinafter be described, by way of the present invention, the upper shelf 12 can be lowered to or past the lower shelf 14 to permit the upper shelf to be moved to a position where it can be readily accessed. As the upper shelf 12 is lowered to or past the lower shelf 14, the lower shelf 14 itself may remain in position or may be raised past the upper shelf 12 to effectively trade positions with the upper shelf 12. Conversely, the upper shelf 12 can be raised up, and the lower shelf 14 lowered such that the shelves are returned to their original positions.

As shown in FIGS. 1 and 2, the uprights 20 are generally box-like beams including lower ends 22 for supporting the shelf system and/or for contacting and/or attachment to a stack of shelves, not shown. The upright 20 could alternatively be interconnected directly to walls or sidewalls, not shown, instead of being interconnected with a stack of shelves. The uprights further include upper ends 24 and front surfaces 26. The front surfaces 26, include inner and outer channels 28 and 29 extending vertically along the length of the uprights 20. The channels 28 and 29 lead to chambers within the uprights 20 comprising shafts of a generally square or rectangular cross-section.

The shelves, generally indicated at 40, include sides 41, upper surfaces 42 and inner edges 43. Interconnected with the shelves, in any manner known in the art, are shelf supports 44, which include support legs 46, telescoping leg portions 48, and shelf member receptacles 49. The support legs 46 at one end coact with the telescoping leg portions 48 to permit the shelf to be moved horizontally away from the uprights 20 and the stack of shelves. Likewise, the shelf member receptacles 49 coact with the telescoping leg portions to further permit such horizontal movement. Of course, any of the members 46, 48 and/or 49 may be smaller or larger than adjacent members to permit such telescoping. The shelf member receptacle 49 is typically formed integrally with the shelves 40. For a non-horizontally moving shelf such as lower shelf 14, the shelf support 44 could merely include support leg 46 interconnected with the shelf in any manner known in the art, or could also be horizontally moveable to facilitate access thereto.

The other ends of the support legs 46, for both horizontally moving and non-horizontally moving shelves, are interconnected with roller blocks generally indicated at 70.

Importantly, the roller blocks 70 are necessarily cube-shaped as shown, but could be of any desired shape in accordance with what is known and practiced in the art. The roller blocks 70 are positioned within the chambers 30 in the uprights 20 and are vertically movable therein by means of rollers 72 positioned at the corners of the blocks 70 which coact with the walls of the chambers 30 to ride up and down the chambers 30. The support legs 46, interconnected at one end to the roller blocks 70, extend through the channels 28 and/or 29 to coact with the shelf 40 with which they are interconnected.

The roller blocks 70 are interconnected and coact by means of a pulley line 74 attached at one end to one roller block 70 and attached at the other end to the other roller block 70. Additionally, the pulley line extends over a pulley wheel 76 mounted on an axle 77 at an upper end of the upright 20. Accordingly, vertical movement of one roller block 70 is translated into an equal vertical movement of the other roller block 70 in the opposite direction as the pulley line 74 is drawn over the pulley wheel 76.

In operation, the upper shelf 12 is moved out in the direction of arrow A from a rest position along the upright 20 and in line with the lower shelf 14. By moving the upper shelf 12 out from the stack of shelves, the telescoping shelf leg 48 is moved out from the shelf receptacle member 49 and/or the support leg 46 to move the inner edge 43 of the upper shelf 40 out past the lower shelf 14. The upper shelf 12 is thus drawn out from the stack of shelves sufficiently to permit the upper 12 to move past the lower shelf 12. Importantly, in the case that the upper shelf 12 is to move to or past the lower shelf 14, it is required that the upper shelf is wider than the lower shelf to permit the upper shelf 12 to move to or past the lower shelf 14, i.e. the upper shelf must be wide enough and must extend for enough out from a stack of shelves that it clears the lower shelf. Of course, it could be the lower shelf that is wider and is moveable out from the shelf supports to permit the upper shelf to be moved to or past the lower shelf.

Figure 8:
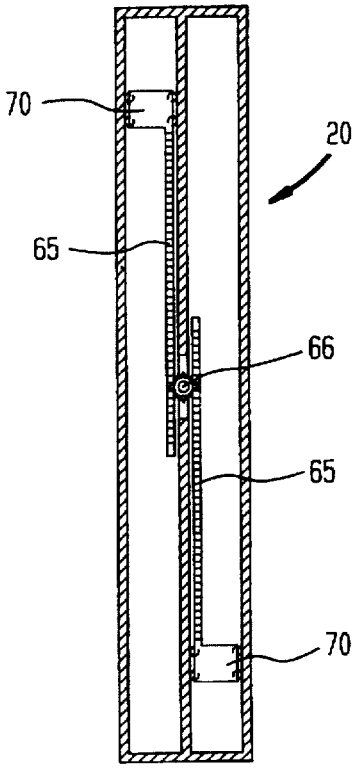
FIG. 8 cross-sectional view of another embodiment of the invention shown in FIG. 1.

After the upper shelf 12 is moved outward from the uprights, it is then moved downward along the direction of arrow B to move the upper shelf 12 to a position where it can be accessed. As the upper shelf 12 is moved down, the lower shelf 14 may remain in position or may be conversely moved up by means of the pulley line 74 and the pulley roller 76, or by other means such as the gear and leg arrangement shown in FIG. 8 wherein movement of one roller block 70 moves the other roller block 70 by means of the coaction between gear bars 65 with gear 66.

Eventually, the upper shelf 12 is positioned at the vertical location that the lower shelf 14 initially maintained, and the lower shelf 14 may be positioned vertically at the location formerly maintained by the upper shelf 12. Thereafter, the upper shelf 12 can be moved inward of the stack to a location in alignment with the stack of shelves and the lower shelf 14. In this position, the upper shelf 12 can be accessed. Of course, the upper shelf 12 can be returned to an upper location by moving the upper shelf 12 out from the stack and upward past the lower shelf 14 which is conversely lowered past to upper shelf 12 to its former lower position. Importantly, in this or any other embodiment of the shelf system of the present invention, the movable shelves could be interconnected with a counterweight, not shown, for preventing any unwanted movement of a loaded shelf with respect to an unloaded shelf, as well as preventing any other unwanted movement.

Figure 3:
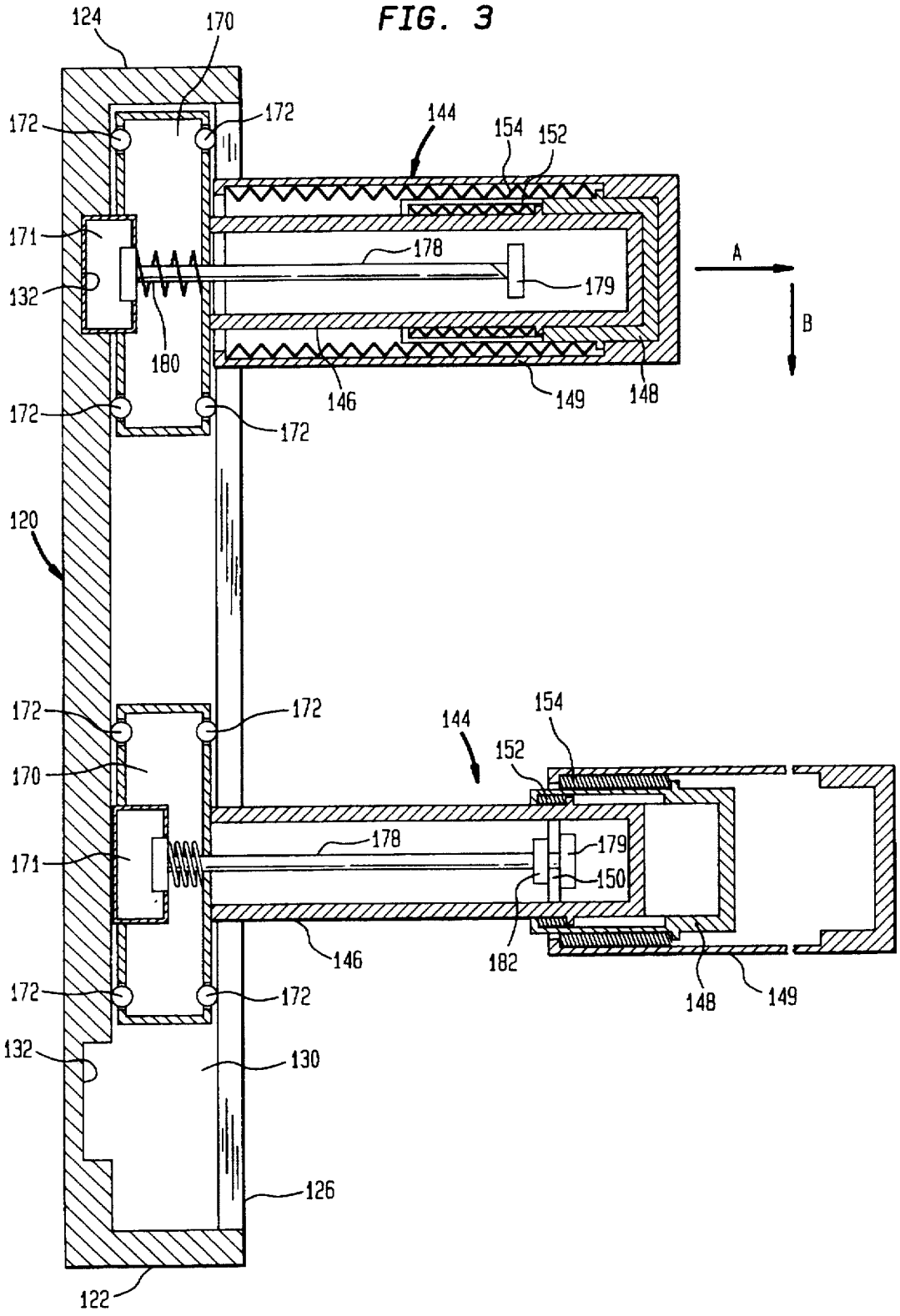
FIG. 3 is cross-sectional view of another embodiment of an upright member for the shelf system shown in FIG. 1, with a shelf support member shown positioned in two different positions with respect thereto
Figure 4:
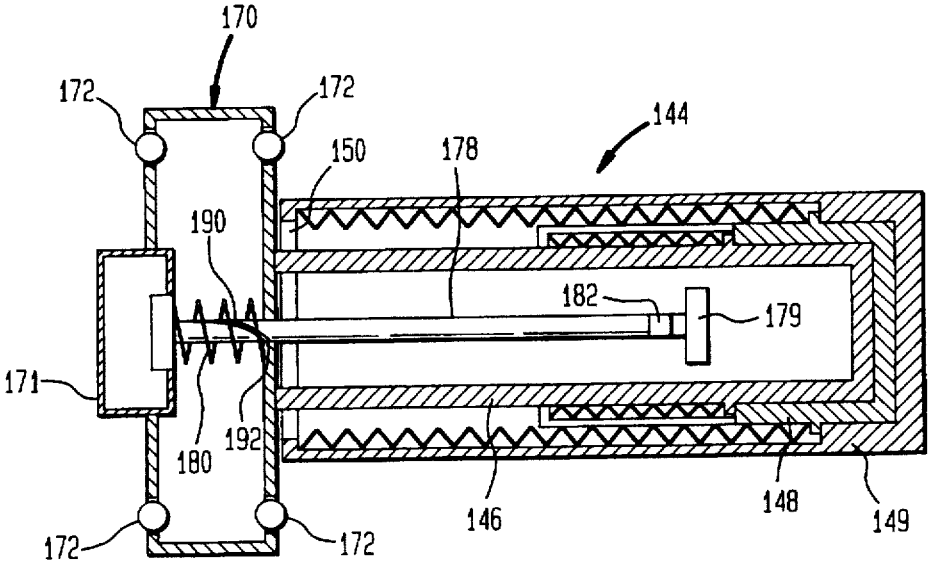
FIG. 4 is a cross-sectional view of the shelf support member shown in FIG. 3.
Figure 5:
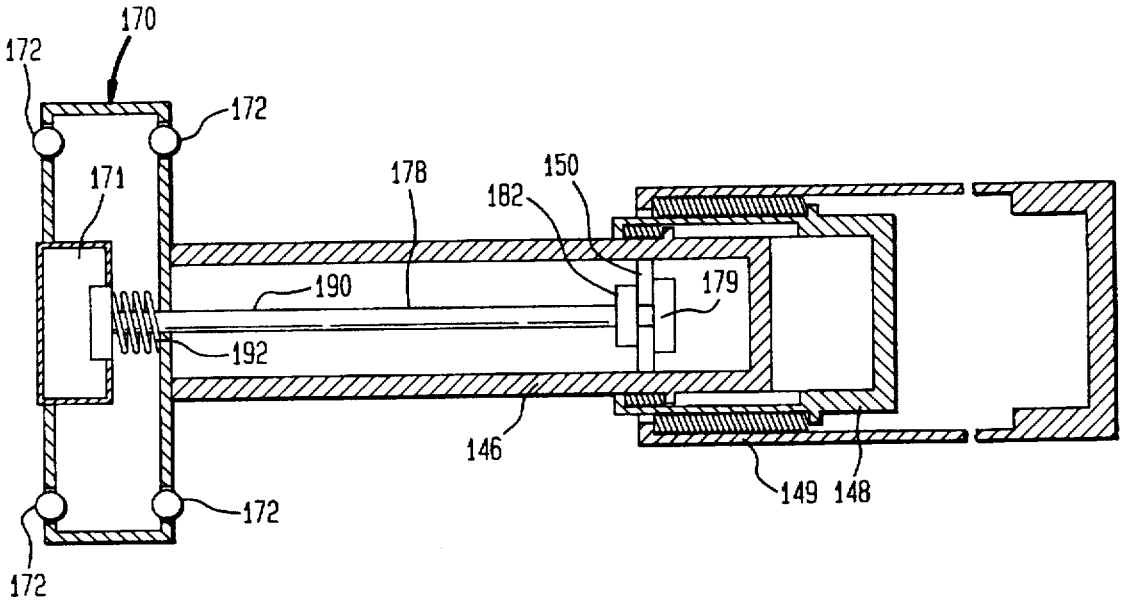
FIG. 5 cross-sectional view of the shelf support member shown in FIG. 4 in an extended position.

Referring now to FIGS. 3–5, another embodiment of the present invention is illustrated. In this embodiment, elements similar to those in the previous embodiment are provided with similar reference numerals plus 100. This embodiment, like the previous embodiment, contemplates supporting shelves on uprights. Accordingly, uprights 120 are provided having upper ends 122, lower ends 124, front surfaces 126, and inner chambers 130. Likewise, the shelves, not shown, are supported on shelf supports 144 which comprise support leg 146, telescoping shelf leg 148 and shelf member receptacle 149. Additionally, the system of this embodiment includes roller car 170 for riding within the inner chamber 130 of the uprights 120, having rollers 172 for coacting with the side walls of the inner chamber 130.

The embodiment of the invention shown in FIG. 3, which depicts the chamber of an upper shelf, includes a mechanism for preventing unauthorized movement of the respective shelves. This mechanism includes stop block 171 associated with the roller car 170, engagable with a receptacle 132 formed within the chamber 130 of the upright 120. When a shelf is located at an upper or lower end of the upright 120, the stop block 171 is biased to extend into the receptacle 132 to prevent movement of the associated shelf. The stop block is horizontally movable with respect to the roller car 170 to permit the stop block 171 to withdrawn therein from engagement with the receptacle.

In order to vertically move the shelf, the shelf must be first moved horizontally out from the upright to withdraw the stop block 171 from the receptacle 132. Horizontal movement of the shelf moves shelf member 149, which includes shelf member shoulder 150. Shelf member shoulder 150 is configured to contact and move stopper 179 formed at the end of puller bar 178. The puller bar 178 is interconnected with the stop block 171 and accordingly, movement of the puller bar 178 moves the stop block 171. Therefore, when the shelf is moved horizontally, shelf member shoulder 150 contacts and moves stopper 179 which pulls puller bar 178 which withdraws the stop block 171 from the receptacle 132. After the stop block 171 is withdrawn from the receptacle 132, the roller car 170 and the shelf can be moved vertically.

The stop block 171 is biased by block spring 180 towards the receptacle 132. Accordingly, after a shelf is pulled out from the stack of shelves, and moved vertically, the stop block 171 bears against the interior wall of the chamber 130. However, when the stop block 171 is positioned in alignment with a receptacle 132, it is naturally urged to seat itself therein. Likewise, springs 152 and 154 associated with the telescoping leg 148 and the shelf member 149 also normally bias the shelf and shelf supports to position in alignment with the stack of shelves.

This bias is overcome when the shelf is fully extended horizontally out from the stack of shelves by a mechanism comprising a helical groove 190 formed along the puller bar 178 which coacts with a cam finger 192 formed on the roller car 170 which, when the puller bar 178 is pulled to withdraw the stop block 171 from the receptacle 132, causes the puller bar to rotate such that a retention hand 182 is rotated to extend past the outside surface of the inner edge of the shelf member shoulder 150 to lock the shelf member shoulder, and hence the entire shelf, in a horizontally extended position. The only way that the shelf can be returned to alignment with the stack of shelves is for the stop block to be brought into alignment with a receptacle wherein it can move into the receptacle causing the puller bar to rotate to thereby rotate the retention hand out of engagement with the shelf member shoulder to unlock the shelf from the extended position.

Figure 6:
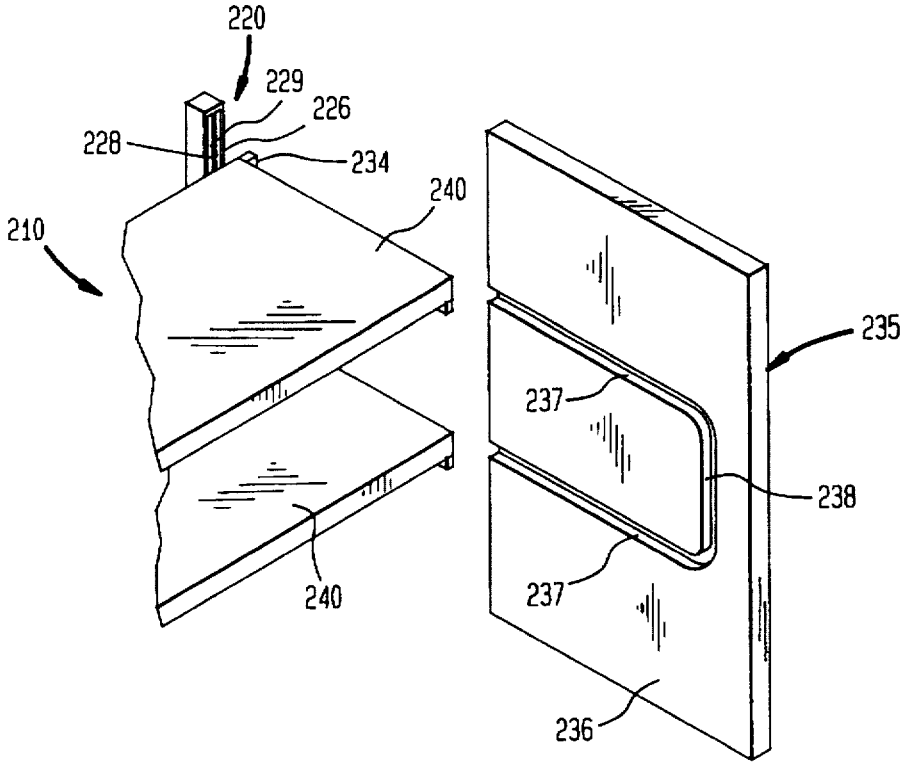
FIG. 6 is a partial perspective view of another embodiment of the shelf system of the present invention.
Figure 7:
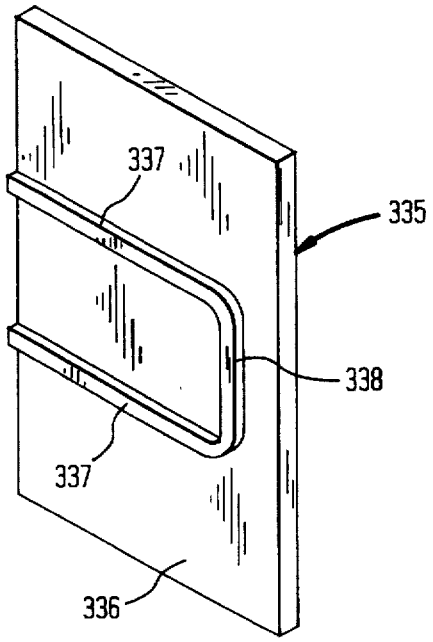
FIG. 7 is a partial perspective view of another embodiment of a side wall for use with the shelf system of the present invention.

Referring now to FIGS. 6 and 7, additional embodiments of the present invention are shown. In these embodiments, the shelf system 210 includes shelves 240 interconnected with uprights 220 having a front surface 226 with inner and outer channels 228 and 229. In these embodiments, however, the upper and lower shelves are moved with respect to each other by means of guide or wheel 234 formed on an edge of the upper shelf for coacting with a groove having upper and lower portions 237 and vertical portion 238 formed on the interior side 236 of side wall 235. The groove guides the upper shelf out from the stack, vertically upward or downward with respect thereto, and then back into alignment therewith. Alternatively, as shown in FIG. 7, instead of a groove, a molding or other member 337, 338 can be formed on an inner surface 336 of a side wall 335 for guiding horizontal and then vertical movement of shelves are hereinbefore described. These embodiments of the present invention are ideal for implementation within cabinets or bookshelves or other types of enclosures having side walls.

Importantly, the configuration of the shelf support members, whether in the form of telescoping legs or as part of side walls, must allow for movement of at least one of the shelves in a horizontal direction so that one of the shelves can be moved out of alignment with an adjacent shelf and then vertically moved passed the adjacent shelf. Any suitable means for effecting such movement is considered within the scope of the present invention. Additionally, it should be pointed out that any number of shelves can be interconnected and moved in unison to effect easy access thereto.

Figure 9:
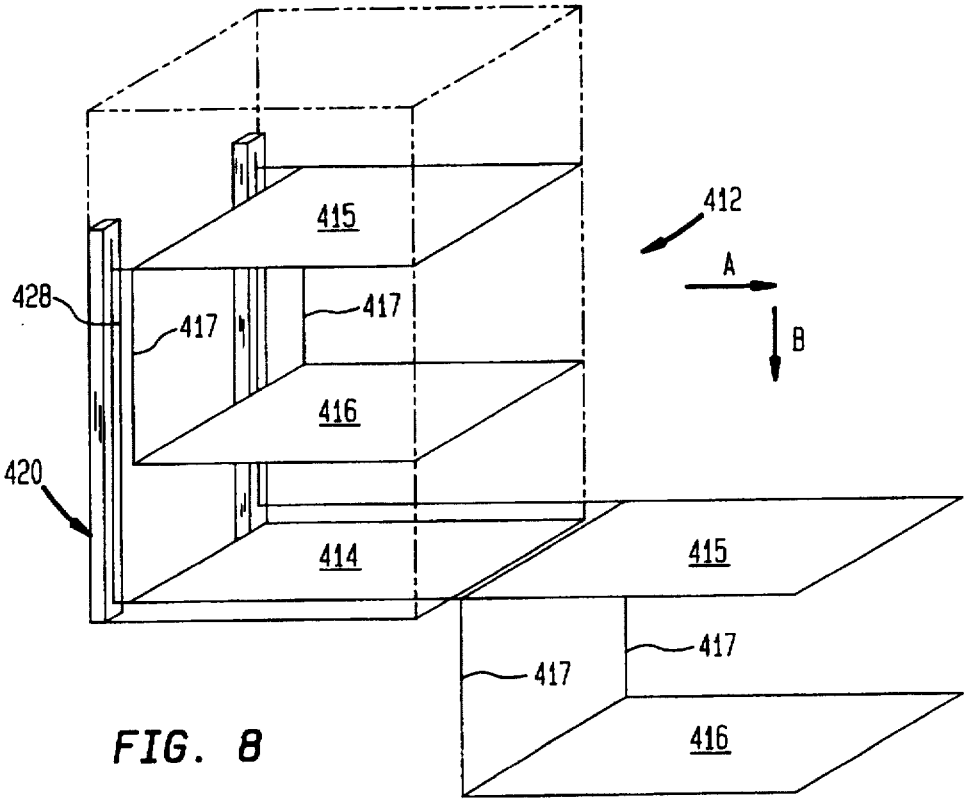
FIG. 9 is a perspective view of another embodiment of the invention shown in FIG. 1.

Referring now to FIG. 9, another embodiment of the present invention is shown where the upper shelf 412 comprises a first shelf 415 and a second shelf 416 interconnected by members 417. Additionally, it should be noted that in this embodiment of the invention, the upright 420 includes only one channel 428 and accordingly, only the to shelf moves to even with the lower shelf 414 but not past the lower shelf 414.

Figure 10:
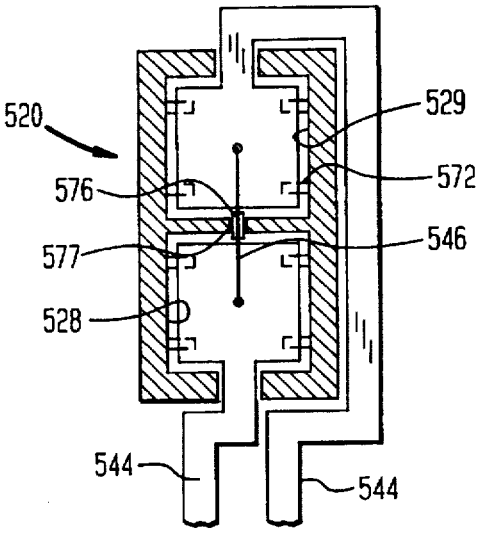
FIG. 10 is cross-sectional view of another embodiment of the upright shown in FIG. 1.

FIG. 10 shows another embodiment of the present invention wherein the inner and outer chambers 528 and 529 in the upright are not positioned side-by-side, but rather are positioned fore and aft of each other. As such, one shelf member 544 exits the front of the upright while the other member 544 exits the back of the upright and extends about the side of the upright to eventually extend parallel to the other member 544.

Having thus described the invention in detail, it is to be understood that the foregoing description is not intended to limit the spirit and scope thereof. What is desired to be protected by Letters Patent is set forth in the appended claims.

What is claimed is:

1. A shelf system apparatus having vertically movable shelves comprising:

a stack of shelves comprising a plurality of shelves supported one above the other;

shelf support means/interconnected at each end of each shelf for supporting each shelf;

a pair of upright means interconnected with the shelf support means for supporting the shelves in the stack;

an upper shelf means supported by an upper shelf support means, the upper shelf support means vertically movable with respect to the stack of shelves;

means for moving the upper shelf means horizontally out from the upright means;

bypass means for moving the upper shelf means to bypass a lower shelf of the stack without detaching the shelf from the shelf support member, the upper shelf support means positioned outboard of the lower shelf support means; and means for moving the upper shelf means horizontally back to the upright means.

2. The apparatus of claim 1 wherein the stack of shelves includes a second shelf positioned below the upper shelf and the bypass means includes means for moving the second shelf upward past the upper shelf.

3. The apparatus of claim 2 wherein the bypass means includes means for moving the second shelf upward in proportion to the distance the upper shelf is moved downward.

4. The apparatus of claim 3 wherein the upper shelf includes a plurality of shelves interconnected together and movable together.

5. The apparatus of claim 3 wherein the upper shelf is horizontally movable away from the stack of shelves to move past the second shelf.

6. The apparatus of claim 5 wherein the upright means comprises an outer channel and an inner channel for receiving the shelf support means.

7. The apparatus of claim 5 wherein the support means associated with the upper shelf interconnects with the support means associated with the lower shelf for translating vertical movement of the upper shelf into equal but opposite vertical movement of the lower shelf.

8. The apparatus of claim 7 wherein means for translating vertical movement from one shelf to the other comprises a pulley line extended between shelves and over a pulley wheel positioned at an upper end of the upright.

9. A vertically movable shelf system apparatus comprising:

a first shelf having opposite ends;

dual upright means;

shelf support members, interconnected with the upright means for supporting the first shelf, the first shelf attached at the opposite ends to the shelf support member;

means associated with the shelf support member for horizontally moving the first shelf away from the upright means;

means associated with shelf support member for vertically moving the first shelf to bypass a second shelf, without detaching the shelf from the shelf support member the shelf support members positioned outboard of the second shelf; and means for horizontally moving the shelf to a position vertically aligned with another shelf, without detaching the shelf from the shelf support member.

10. The apparatus of claim 9 further comprising means for moving the shelf vertically past another shelf.

11. The apparatus of claim 10 further comprising means for returning the shelf to an original horizontal position.

12. The apparatus of claim 11 further including a roller car interconnected with the shelf support means for vertically moving the shelf.

13. The apparatus of claim 12 further comprising means for locking the shelf in a desired position to prevent the shelf from unauthorized vertical movement.

14. The apparatus of claim 13 wherein the shelf further comprises means to lock the shelf in a horizontally extended position until properly vertically aligned.

15. A method of accessing an upper shelf comprising the steps of:

providing a plurality of shelves attached to a pair of upright supports by a pair of shelf supports;

moving at least one of the plurality of shelves horizontally from the upright supports, without detaching the shelf supports from the upright supports;

moving the at least one of the plurality of shelves vertically to another position with respect to the upright support to bypass a lower shelf, the pair of shelf supports positioned outboard of a lower shelf without detaching the shelf from the upright supports; and returning the at least one of the plurality of shelves to the upright support by horizontally moving the at least one of the plurality of shelves to the upright supports.

16. The method of claim 15 further comprising the step of moving the shelf past vertically past another shelf.

17. The method of claim 16 further comprising the step of horizontally moving the shelf to return the shelf to a normal position.

18. The method of claim 17 further comprising the step of moving a second shelf in a vertically opposite direction.

* * * * *